US010194726B2

(12) United States Patent
Mosee

(10) Patent No.: US 10,194,726 B2
(45) Date of Patent: Feb. 5, 2019

(54) UTILITY HANDBAG

(71) Applicant: Sherrill W. Mosee, Philadelphia, PA (US)

(72) Inventor: Sherrill W. Mosee, Philadelphia, PA (US)

( * ) Notice: Subject to any disclaimer, the term of this patent is extended or adjusted under 35 U.S.C. 154(b) by 256 days.

(21) Appl. No.: 15/187,568

(22) Filed: Jun. 20, 2016

(65) Prior Publication Data

US 2016/0316877 A1 Nov. 3, 2016

Related U.S. Application Data

(62) Division of application No. 13/875,432, filed on May 2, 2013, now Pat. No. 9,375,061.

(60) Provisional application No. 61/734,892, filed on Dec. 7, 2012, provisional application No. 61/695,054, filed on Aug. 30, 2012, provisional application No. 61/642,748, filed on May 4, 2012.

(51) Int. Cl.

| | |
|---|---|
| ***A45C 1/02*** | (2006.01) |
| ***A45C 13/02*** | (2006.01) |
| ***A45C 3/06*** | (2006.01) |
| ***A45C 7/00*** | (2006.01) |
| ***A45C 13/10*** | (2006.01) |

(52) U.S. Cl.

CPC ..... *A45C 13/02* (2013.01); *A45C 1/02* (2013.01); *A45C 3/06* (2013.01); *A45C 7/0063* (2013.01); *A45C 7/0086* (2013.01); *A45C 13/1046* (2013.01)

(58) Field of Classification Search

CPC .. A45C 3/06; A45C 13/26; A45C 3/00; A45C 13/10; A45C 3/04

USPC ..... 150/107, 112, 113, 108, 106; 190/103, 190/106, 107, 109, 111, 18 A

See application file for complete search history.

(56) References Cited

U.S. PATENT DOCUMENTS

| | | | | | |
|---|---|---|---|---|---|
| 450,988 | A | | 4/1891 | Brown | |
| 1,559,307 | A | | 10/1925 | Bernardo | |
| 1,628,812 | A | | 5/1927 | Shwayder | |
| 2,164,493 | A | * | 7/1939 | Branen | A45C 3/00 190/111 |
| 2,180,191 | A | * | 11/1939 | Bauch | A45C 3/02 190/111 |
| 2,213,821 | A | | 9/1940 | McCurdy | |
| 2,540,165 | A | | 2/1951 | Fiel | |
| 2,540,185 | A | * | 2/1951 | Brown | H01H 51/065 200/250 |
| 2,585,745 | A | * | 2/1952 | Crosby | A45C 3/00 190/109 |
| 2,705,063 | A | | 3/1955 | Torrent | |
| 2,788,823 | A | | 4/1957 | Walser | |
| 3,870,132 | A | | 3/1975 | Hanley | |
| 3,963,102 | A | | 6/1976 | Carp | |

(Continued)

*Primary Examiner* — Fenn C Mathew
*Assistant Examiner* — Cynthia Collado
(74) *Attorney, Agent, or Firm* — Paul & Paul

(57) ABSTRACT

A 2-in-1 handbag with an adjustable compartment system for providing a foundation handbag, an insulated secondary inner handbag with an adjustable compartment system to create separate compartments for storage and organization of items such as wallet, cosmetics, baby items, clothing, shoes, toiletry and/or food within the handbag system. The 2-in-1 handbag with an adjustable compartment system generally includes a foundation handbag, insulated secondary inner handbag with an adjustable compartment system.

3 Claims, 16 Drawing Sheets

(56) References Cited

U.S. PATENT DOCUMENTS

| | | | | | |
|---|---|---|---|---|---|
| 4,212,377 | A | | 7/1980 | Weinreb | |
| 4,334,601 | A | | 6/1982 | Davis | |
| 4,354,542 | A | | 10/1982 | Gerch | |
| 4,506,769 | A | | 3/1985 | Franco et al. | |
| 4,561,525 | A | | 3/1985 | Shidner | |
| 4,941,603 | A | * | 7/1990 | Creamer | A45F 3/04 150/109 |
| 4,984,662 | A | | 1/1991 | Jacober | |
| 5,090,526 | A | * | 2/1992 | Jacober | A45C 7/0077 190/107 |
| 5,207,254 | A | * | 5/1993 | Fromm | A45C 3/08 150/104 |
| 5,356,004 | A | | 10/1994 | Weinreb | |
| 5,526,907 | A | | 6/1996 | Trawick et al. | |
| 5,813,445 | A | | 9/1998 | Christman | |
| 5,833,114 | A | | 11/1998 | Linnell | |
| 5,842,571 | A | | 12/1998 | Rausch | |
| 5,868,227 | A | | 2/1999 | Garcia | |
| 5,950,834 | A | | 9/1999 | Woodnorth et al. | |
| 6,047,752 | A | | 4/2000 | Southwick | |
| 6,213,268 | B1 | | 4/2001 | Dancyger | |
| 6,439,389 | B1 | | 8/2002 | Mogil | |
| 6,561,329 | B2 | * | 5/2003 | Stobbs, II | A45C 3/00 190/112 |
| 6,640,944 | B2 | | 11/2003 | Adams | |
| 6,688,470 | B2 | | 2/2004 | Dege | |
| 7,255,252 | B2 | | 8/2007 | Lovett | |
| 7,334,684 | B1 | | 2/2008 | Fontanilla | |
| 7,779,976 | B2 | * | 8/2010 | Mangano | A45C 13/02 190/110 |
| 8,001,803 | B2 | | 8/2011 | Kanagaki | |
| 8,281,950 | B2 | | 10/2012 | Potts | |
| 8,869,960 | B2 | | 10/2014 | Mangano | |
| 2002/0148741 | A1 | | 10/2002 | Stobbs et al. | |
| 2004/0007486 | A1 | | 1/2004 | Bergh et al. | |
| 2004/0071371 | A1 | | 4/2004 | Maher et al. | |
| 2006/0201979 | A1 | | 9/2006 | Achilles | |
| 2008/0083592 | A1 | * | 4/2008 | Mangano | A45C 7/0077 190/110 |
| 2009/0052809 | A1 | | 2/2009 | Sampson | |
| 2009/0184143 | A1 | | 7/2009 | Witt | |

* cited by examiner

UTILITY HANDBAG

CROSS-REFERENCE TO RELATED APPLICATIONS

This application is a division of pending U.S. patent application Ser. No. 13/875,432, filed May 2, 2013, which claims priority of U.S. Provisional Application 61/642,748, filed May 4, 2012, U.S. Provisional Application 61/695,054, filed Aug. 30, 2012, and U.S. Provisional Application 61/734,892, filed Dec. 7, 2012, and incorporates by reference the disclosures thereof, as if recited herein in full.

BACKGROUND OF THE INVENTION

The present invention is directed to and relates generally to handbag systems and more specifically it relates to a 2-in-1 handbag with an adjustable compartment system for providing a foundation handbag, an insulated secondary inner handbag with an adjustable compartment system to create separate compartments for storage and organization of items such as wallet, cosmetics, baby items, clothing, shoes, toiletry and/or food within the handbag system.

SUMMARY OF THE INVENTION

An object of the present invention is to provide a 2-in-1 handbag with an adjustable compartment system for providing a foundation handbag, an insulated secondary inner handbag with an adjustable compartment system to create separate compartments for storage and organization of items such as wallet, cosmetics, baby items, clothing, shoes, toiletry and/or food within the handbag system.

Another object of the present invention is to provide a 2-in-1 handbag with an adjustable compartment system that has a foundation handbag also known as the outer bag housing the insulated secondary inner handbag in the lower compartment of the outer bag.

A further object of the present invention is to provide a 2-in-1 handbag with an adjustable compartment system that has a removable secondary inner bag that can be expanded in height to provide additional storage space and is insulated to keep food items cool or warm and can be carried as a separate handbag.

Yet, another object of the present invention is to provide a 2-in-1 handbag with an adjustable compartment system that has a front or alternative side flap which opens to access the secondary inner handbag in the lower compartment of the handbag system.

An even further object of the present invention is to provide a 2-in-1 handbag with an adjustable compartment system that has an adjustable dividing system that is permanently or temporarily attached to the inside walls of the foundation handbag to create upper and lower compartments within the handbag system.

Another object is to provide a 2-in-1 handbag with an adjustable compartment system that has a flap(s) hinged to the bottom floor of the foundation handbag that acts as a separator when pulled to a 90 degree angle creating additional compartments within the lower compartment of the handbag system.

Another object is to provide a 2-in-1 handbag with an adjustable compartment system that has a lower compartment in the handbag system which can be insulated and serve as a food storage compartment when the divider is in its closed position, and the bottom flap is at 0 degrees to keep food items cool or warm.

Another object is to provide a 2-in-1 handbag with an adjustable compartment system that can adjust from a single compartment handbag or create a system of compartments within the handbag system.

Another object is to provide a 2-in-1 handbag with an adjustable compartment system that can alternatively include an adjustable lining system that includes an interlocking system to expand or contract the lining in length to create multiple compartments. The adjustable lining system is permanently or temporarily attached to the upper inside walls of the foundation handbag, which expands or contracts in length/depth to create an upper and lower compartment within the handbag system.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated while remaining within the scope and intent of the present invention.

BRIEF DESCRIPTION OF THE DRAWINGS

The features, advantages and operation of the present invention will become readily apparent and further understood from a reading of the following detailed description with the accompanying drawings, in which like numerals refer to like elements, and in which.

DETAILED DESCRIPTION OF THE INVENTION

The present invention is a 2-in-1 utility bag 10, FIG. 1, having a foundation handbag, an insulated secondary inner handbag, and an adjustable compartment system.

a. Foundation Bag

Figure 1A:
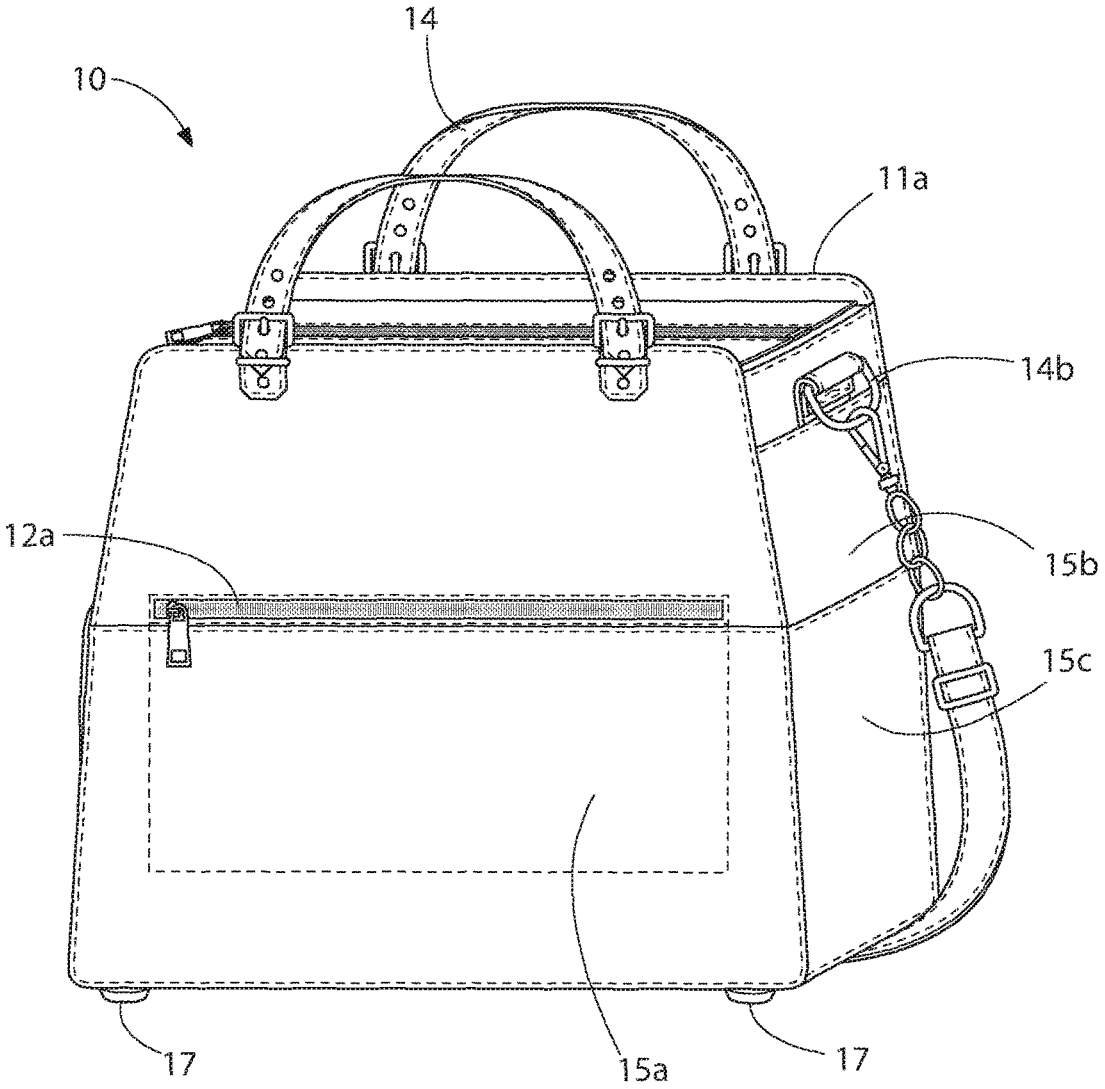
FIG. 1*a* is a front view of the present handbag invention.
Figure 1B:
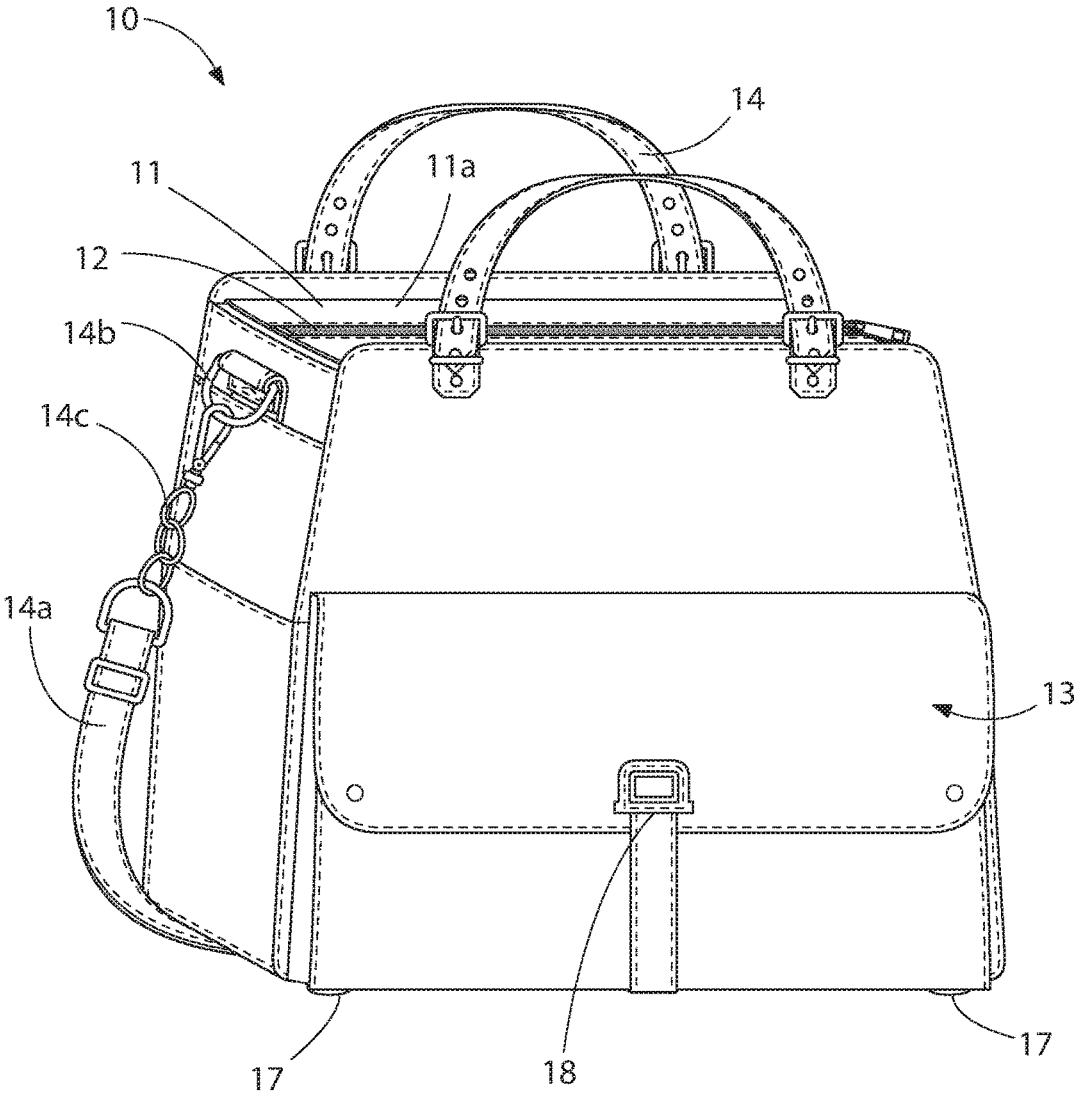
FIG. 1*b* is a back view or the handbag of FIG. 1*a;*

The foundation handbag 10, FIGS. 1*a*, 1*b*, 2, 3, and 4*a*, has a main compartment 11 with access at the top 11*a* of the bag. This compartment may be divided into an upper compartment 24 and a lower compartment 25. The interior of the bag is also accessible through the front of the bag 10, or alternately through the side of the bag with a front flap 13 closure and a side flap closure 61, FIG. 8*a*. A pair of handles 14, FIGS. 1*a*, 1*b*, are used to carry the bag 10. The bag 10 also includes inside pockets, side pockets and front and back pockets. It can hold a secondary inner bag 40, FIGS. 5*a*, 5*b*, and 7*a*-7*c*, which is removable and may be insulated. Also included is an adjustable interior dividing system.

Figure 2:
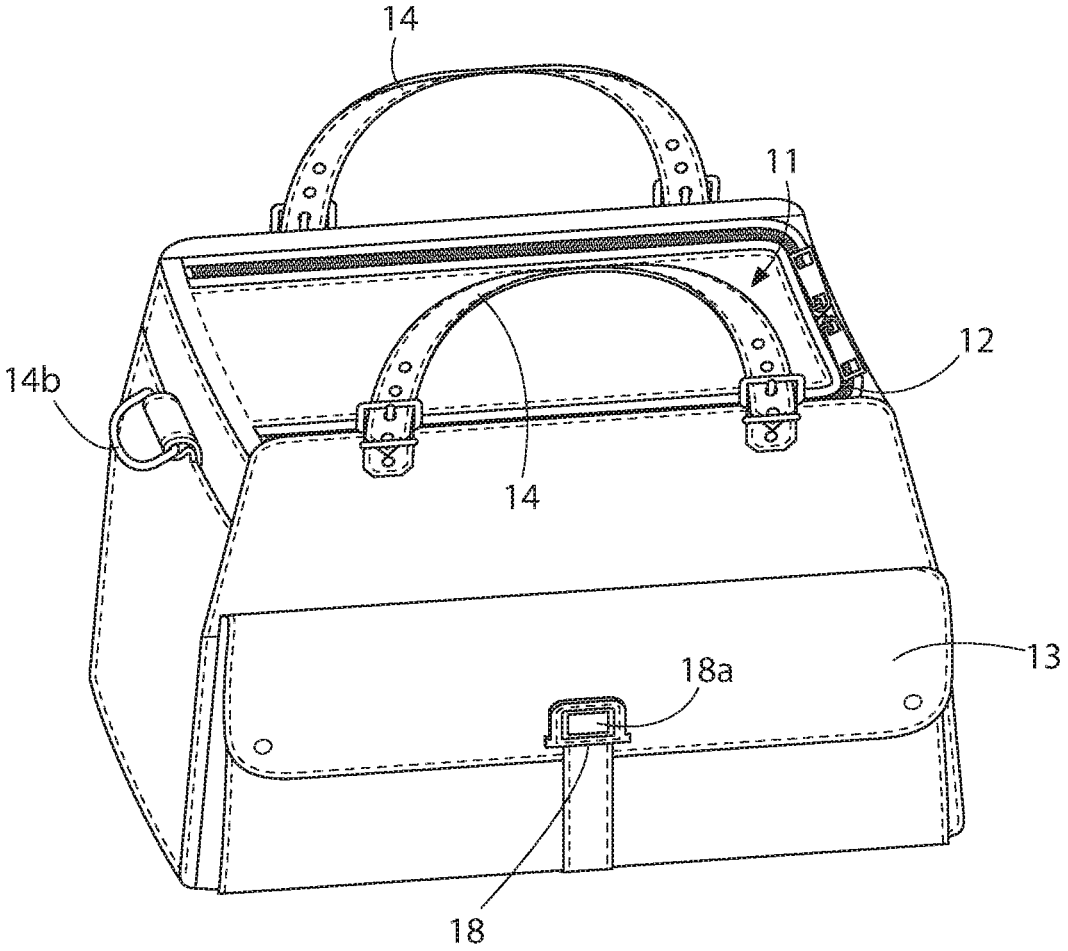
FIG. 2 is a top perspective view of the handbag when open showing the removable divider floor.
Figure 3:
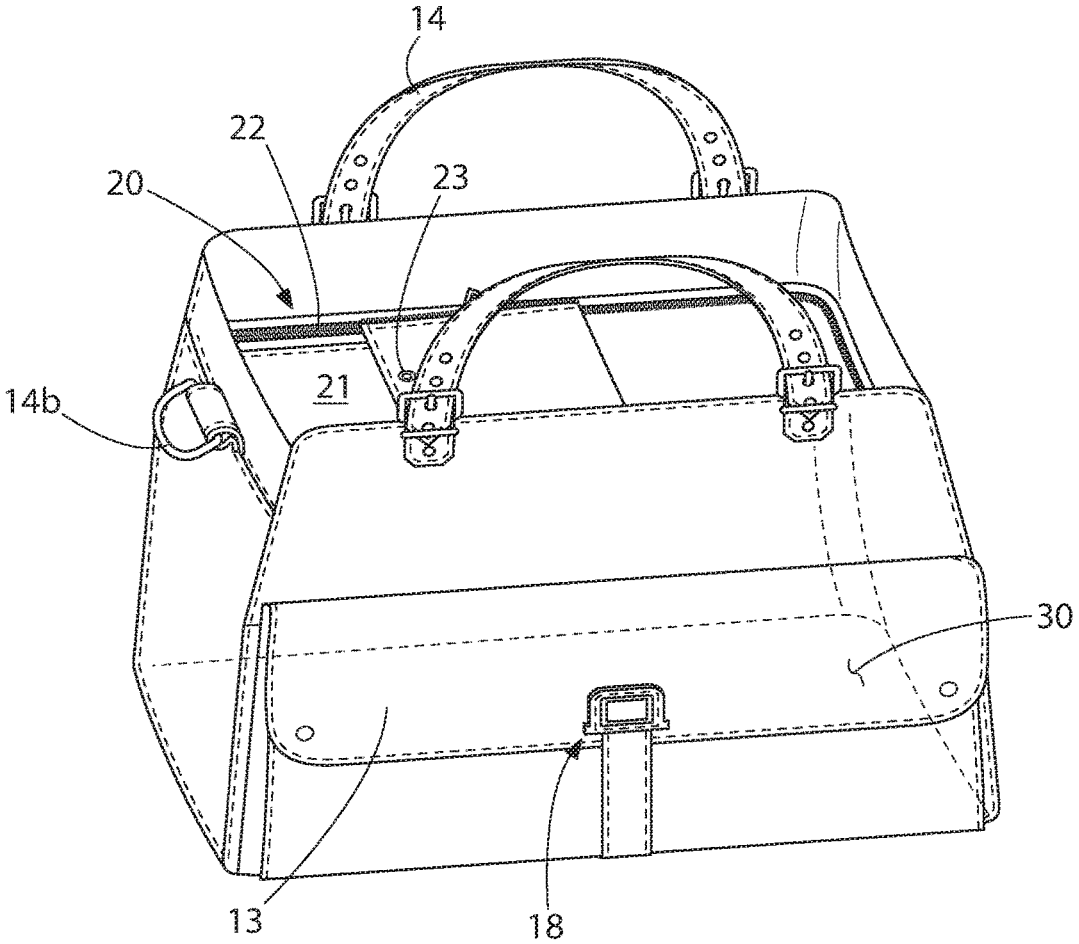
FIG. 3 is a top perspective view of the handbag of FIG. 2 with the removable divider floor partially open.

Access to the main compartment 11 of the handbag 10 is through the top 11*a* of the handbag, which can be held closed by means of a zipper 12, FIGS. 1*b* and 2. The back of the bag 10 can have a shallow outside pocket 15*a* accessible through another zipper 12*a*, FIG. 1*a*, extending partially, across the back of the bag. Additional outside pockets 15*b*, 15*c* are located on each end of the bag 10.

In addition to the pair of handles 14, the bag 10 can have a shoulder strap 14*a* attached to mounting loops 14*b* secured one each to each end of the bag 10. The strap can be lengthened or shortened by adding or removing a series of metal links 14*c*, FIG. 1*b*. The bag 10 can have footed bottoms (bottom feet) 17 and the front flap 13 is held closed with a strap-type fastener 18. This fastener can have a slide-through spade end with a spring button 18*a*, FIG. 2. Alternately, a snap engagement can be used for the spade end.

Figure 4A:
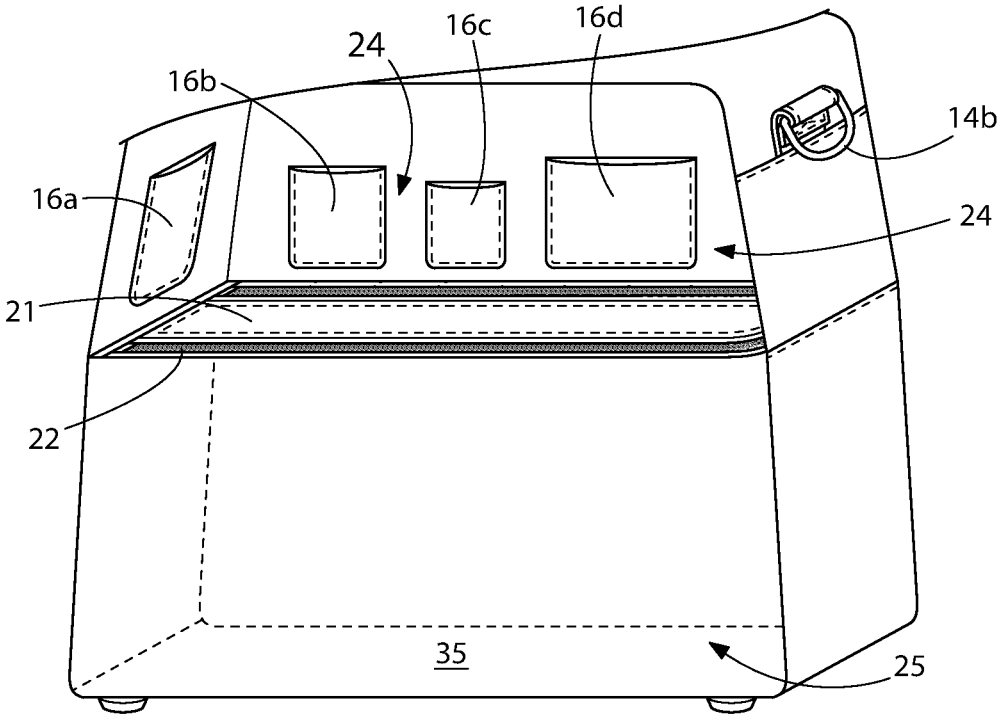
FIG. 4*a* is a front cut-away view of the handbag with the divider floor in a horizontal position.
Figure 4B:
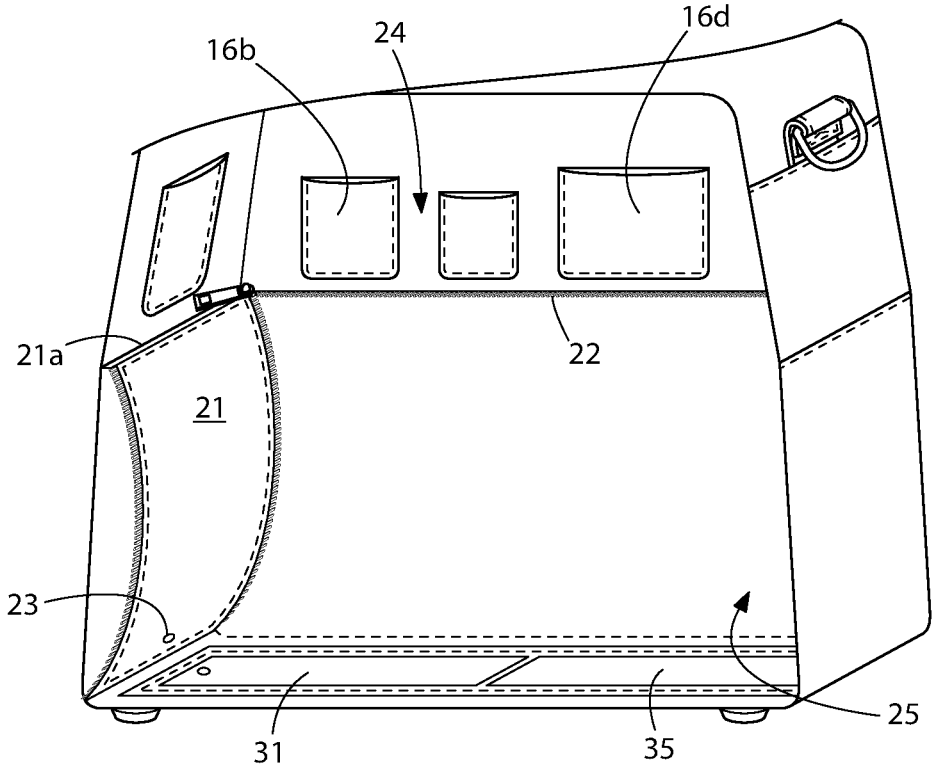
FIG. 4*b* is a front cut-away view of the handbag with the divider floor released from the sidewalls.
Figure 4C:
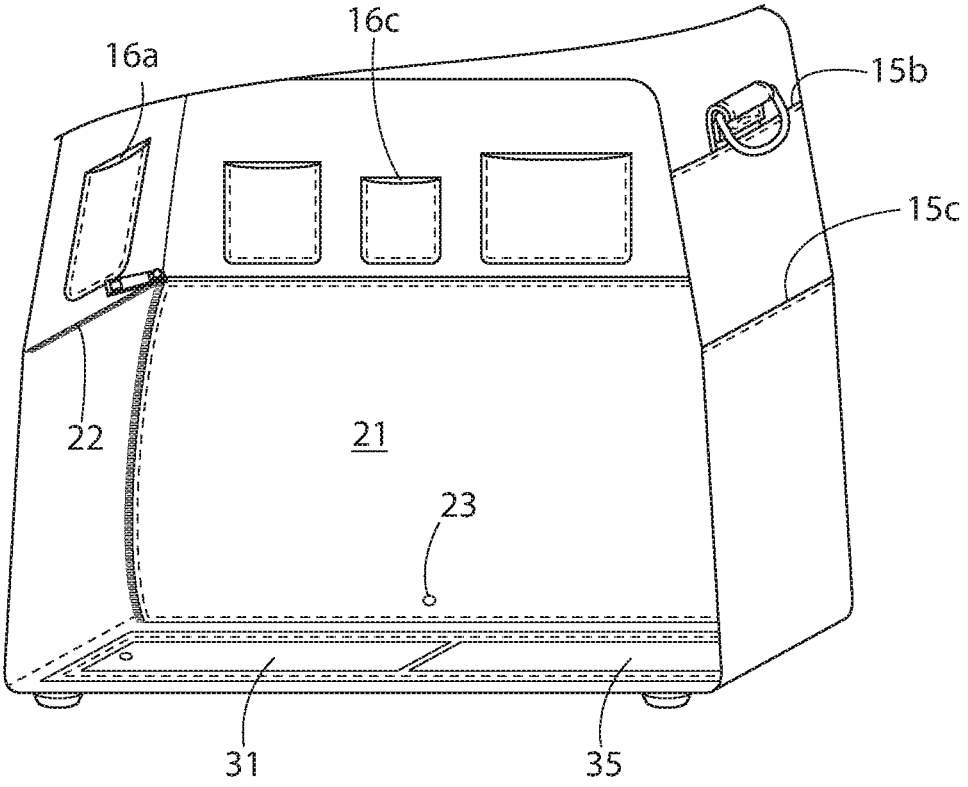
FIG. 4*c* is a side cut-away view of the handbag with the divider folded against the end wall.

The handbag 10 main compartment 11 can be divided into an upper compartment 24 and a lower compartment 25, FIGS. 4*a*, 4*b*, using an adjustable upper dividing system 20 and an adjustable lower dividing system 30, FIGS. 3, 4*a*, 4*b*, 6*a* and 12*b*. The upper dividing system 20 includes a divider floor 21, the interim-bag-height zipper 22, and a snap fastener 23 for holding the divider floor 21 to the side of the bag when the zipper 22 is released. In the alternative to a zipper 22 and the snap fastener 23, any number of other fasteners can be used such as hook-and-loop, clips and other known fasteners. The upper dividing system 20 is used when the owner wants to compartmentalize the interior of the bag 10. The zipper 22 extends along two sides of the divider floor 21 with the open end of the divider floor having fasteners 23*a*, 23*b* to attach the divider floor to the opposite side wall of the interior 11 of the bag, or alternately the zipper 22 extends around two sides and one end of the divider floor 21, FIGS. 4*a* and 4*b*. The remaining end 21*a* of the divider floor 21 is permanently attached to the interior side wall of the bag 10 and permits the floor 21 to fold against an interior wall to stand out of the way. The divider floor 21 can either be attached to an end wall of the interior of the bag 10, FIG. 4*b*, or attached to a back wall, but preferably the side wall adjacent the flap 13 opening.

A plurality of interior pockets 16*a*, 16*b*, 16*c*, 16*d*, can be positioned on the inside walls of the upper compartment 24, FIGS. 4*a*, 4*b*, 4*c*, and 6*a*.

The lower dividing system 30 is used to create additional compartments within the lower compartment 25 of the handbag 10. The lower dividing system 30 includes one or more folding panels or flaps 31 attached to the bottom floor 35 of the bag 10, FIGS. 4*a*, 4*b*, 4*c*, 6*a*, and capable of being folded into an upright position, FIGS. 4*b*, 4*c*. A single flap 31, FIG. 6*a*, can divide the lower compartment 25 into a right compartment 33 and a left compartment 34. The divider floor 21 is required to be in position for holding the flap 31 upright. The flap 31 carries a fastener structure 32 for engaging the bottom face of the divider floor 21 for securing the flap 31 in the upright position separating the lower compartment 25 into two sub-compartments, the right one 33 and a left one 34, within the lower compartment of the handbag 10.

Figure 5A:
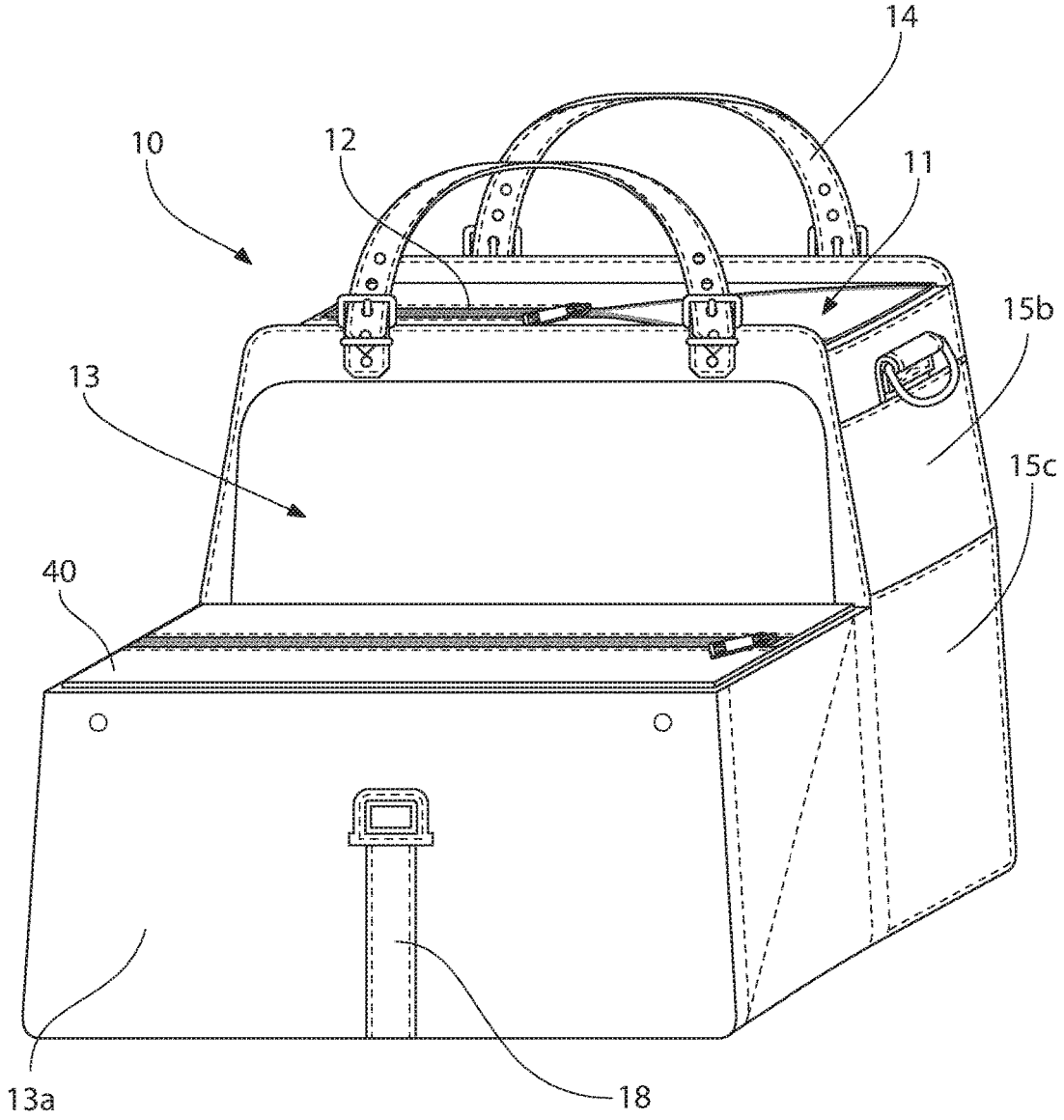
FIG. 5*a* is a front perspective view with the front flap open and the secondary inner bag partially out of the bottom compartment.
Figure 5B:
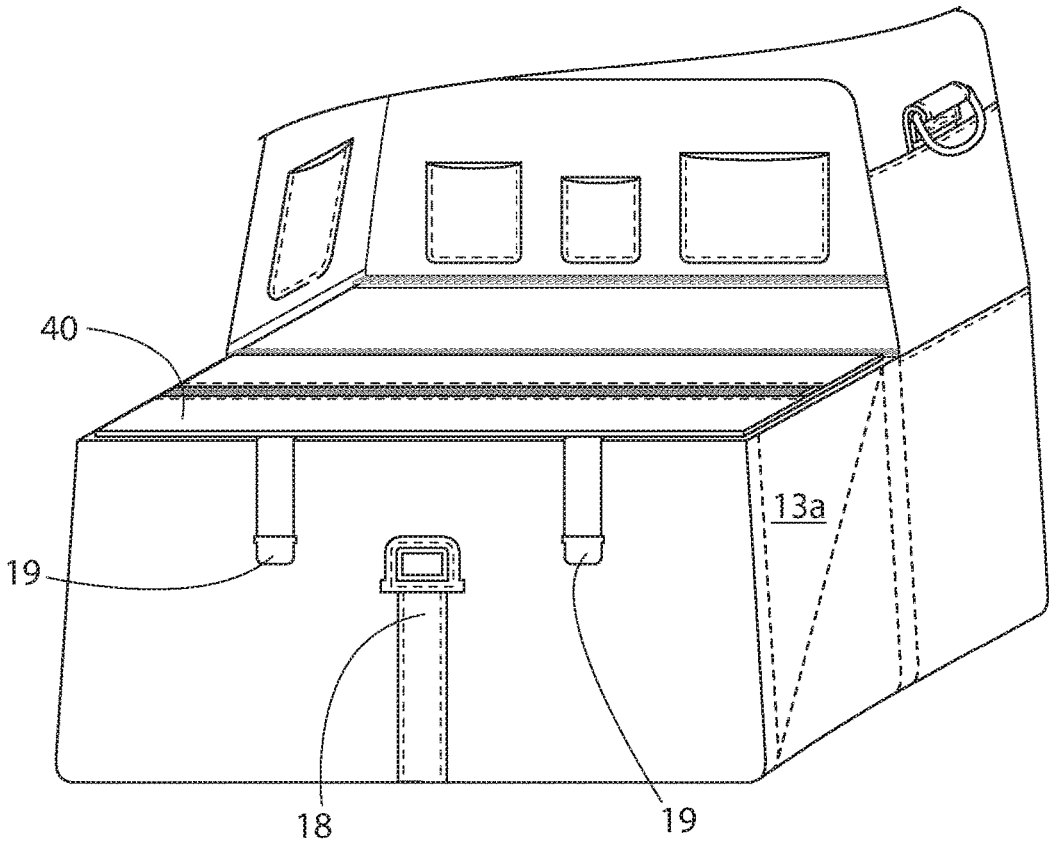
FIG. 5*b* is a front partial cut-away view of FIG. 5*a;*

With the lower compartment flap 31 folded down, or not a part of the bag 10, the lower compartment can hold an insulated secondary inner bag 40 which is removable from the bag 10, either through its open top, or through the front sidewall of the bag closed with the front flap 13, FIGS. 5*a* and 5*b*. Thus, opening the front flap 13 gives access to the interior 11 of the bag at its lower compartment 25, this access being through an access opening (not shown) in the front of the bag 10. Surrounding this opening is a pouch 13*a* which folds outwardly when released by the front flap 13. The pouch 13*a* sides fold against the front of the bag 10 to close the pouch 13*a* and be secured by the front flap 13 and the fastener 18, and to the insulated secondary inner handbag 40 situated in the lower compartment 25.

The insulated secondary inner handbag 40 can be removed through the pouch 13*a* once the front flap 13 is opened and carried separately. The front edge of the pouch 13*a* includes a pair of clamping clips 19, FIG. 5*b*, which are attachable to the insulated secondary inner handbag 40 so that the secondary bag 40 is pulled outwardly when the pouch 13*a* is pulled outward. The above-recited dividing system and insulated secondary inner bag may be incorporated into other structures, such as luggage, cosmetic cases, travel bags, athletic bags, and totes.

Figure 8A:
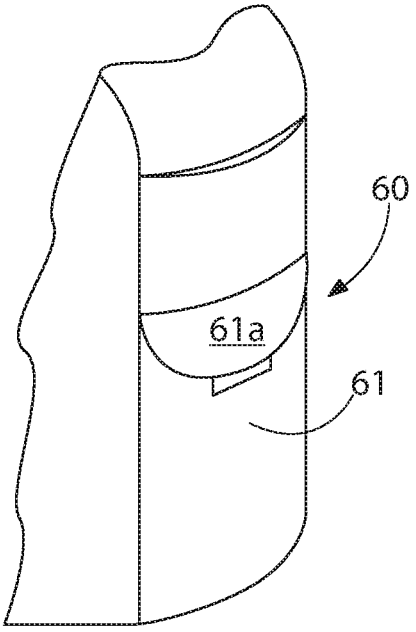
FIG. 8*a* shows an alternate embodiment of the handbag with an additional side flap at one end.
Figure 8B:
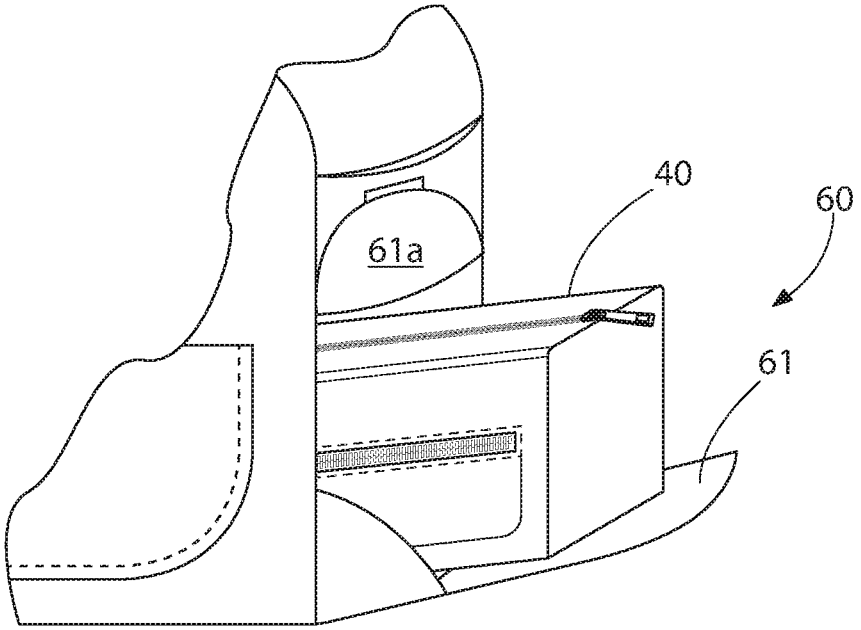
FIG. 8*b* shows that the insulated secondary inner bag can be removed through this side flap as well as the front flap.

An alternative access 60, FIGS. 8*a* and 8*b*, can be provided to the insulated secondary bag 40 in the lower compartment 25. This access includes a side flap 61 which pivots outwardly and an upper keeper flap 61*a*, which keeps the side flap against the gusset of the bag 10.

b. Adjustable Upper Dividing System

Figure 6A:
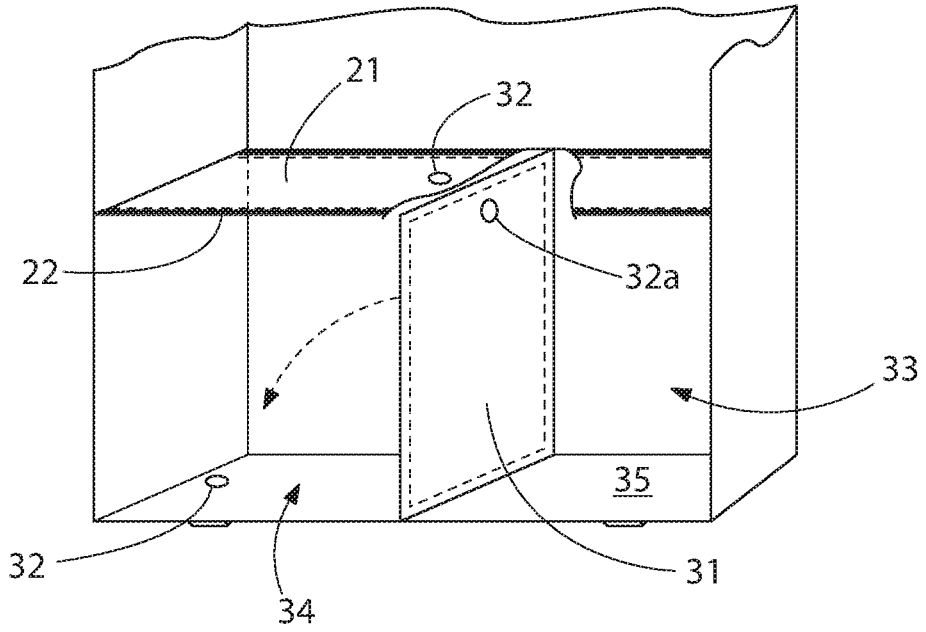
FIG. 6*a* is a rear cut-away view of the bag with the divider floor against the bottom and partially raised.
Figure 9A:
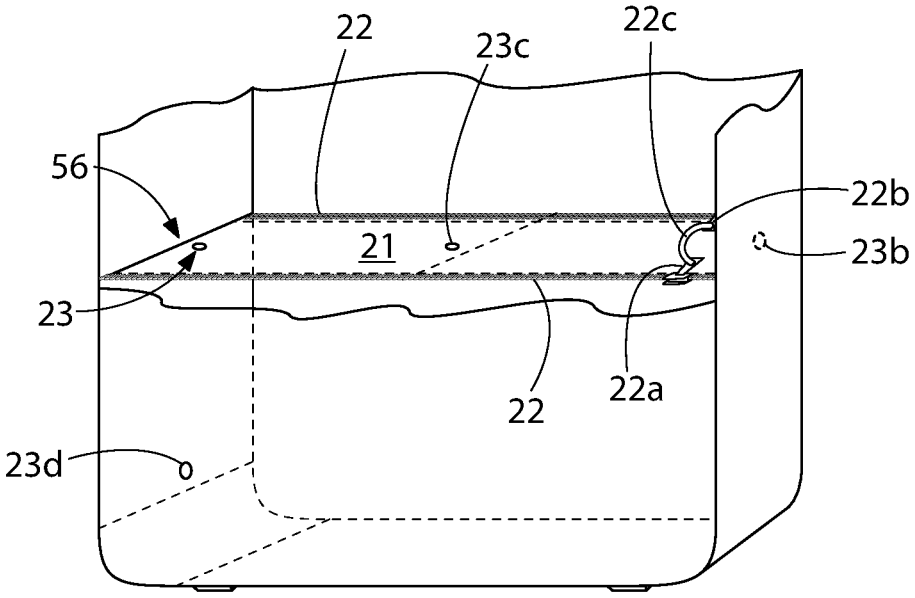
FIG. 9*a* is a perspective cut-away view of the handbag with the divider floor secured in place.

The upper divider floor 21 is an adjustable upper or panel fixedly attached to the inside walls of the foundation bag 10 to create a floor for the upper compartment 24 thereby separating the main compartment 11 into upper 24 and lower 25 compartments, FIGS. 4*a*, 6*a*, and 9*a*.

Figure 9B:
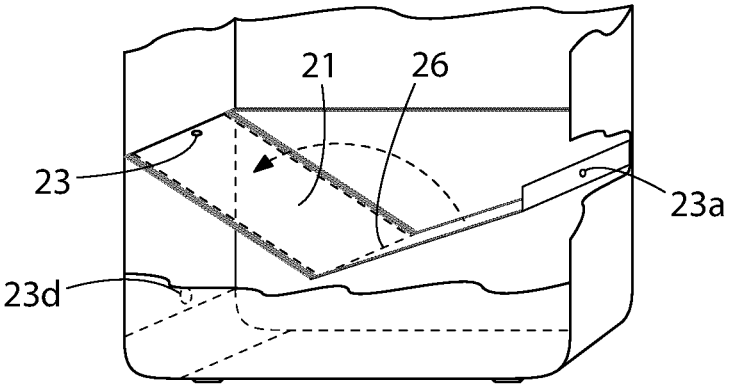
FIG. 9*b* is a perspective cut-away view of the handbag with the divider floor released on three sides and partially folded.
Figure 9C:
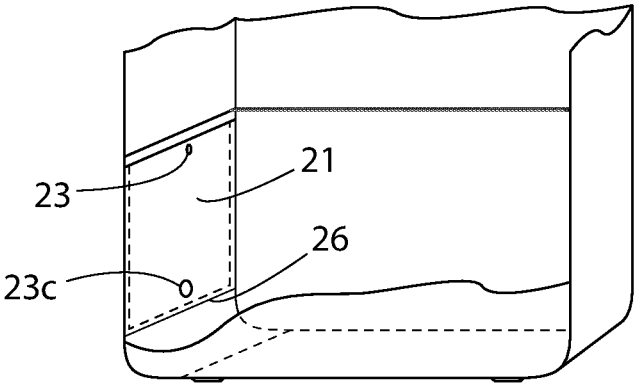
FIG. 9*c* is a perspective cut-away view of the handbag with the divider floor folded against an end of the handbag.

This divider floor 21 can be affixed and adjusted in height to the inside walls of the bag main compartment 11, to create less or more space in the upper or lower compartments. The adjustable divider can be permanently, or temporarily, affixed to the inside walls of the main compartment 11 of the bag by stitch, zipper, hook-and-loop, snaps or any other known means for securing the divider to the inside walls, FIG. 9*a*. The adjustable upper divider system may pivot or fold, FIGS. 9*b* and 9*c*, to allow access to the upper and lower compartments of the bag.

The adjustable divider 21 is attached and affixed by zipper 22 or other fastener system which extends along both sides of the divider 21 with open end attached to the side wall by magnetic fastener or another type of fastener. The other end is secured to the end wall of the bag with a gusset 56 reinforcement which permits the divider floor 21 to fold downwardly from the attachment, FIG. 9*b*. The divider floor 21 has a mid-length fold 26 which allows the divider 21 to fold in-half against the end wall. Snap fasteners 23, 23*a*, 23*c* and 23*d* are used to secure the folded divider 21 against the end wall, FIG. 9*c*. The released end of the divider 21 may have a second snap fastener 23*a* to mate with a snap fastener adjacent the permanently attached end of the divider 21, thereby eliminating the need for a fastener member on the inside end wall of the bag.

The adjustable upper dividing system 20 creates an upper compartment 24 and lower compartment 25 within the foundation handbag system. Access to the upper dividing system is through the top of the main compartment 11 or through the front flap 13. The adjustable dividing system is made of stiff fabric material known as the divider 21 and is attached to the inside walls of the foundation handbag by zipper 22 or any other known fastener. The divider 21 may be permanently or temporarily attached to the inside gusset 56 of the foundation handbag or the inside back wall of the foundation handbag using zippers to attach the remaining portion of the divider to the handbag. When the divider 21 is in its closed position it creates the upper and lower compartments 24 and 25 within the handbag system. When the divider is unzipped and in an open position it pivots or folds at the fold line 26 downward to create a single compartment. When the divider 21 is in its open position, the user may connect or fasten the divider 21 to the back wall or gusset of the foundation handbag to hold the divider in place.

Figure 8C:
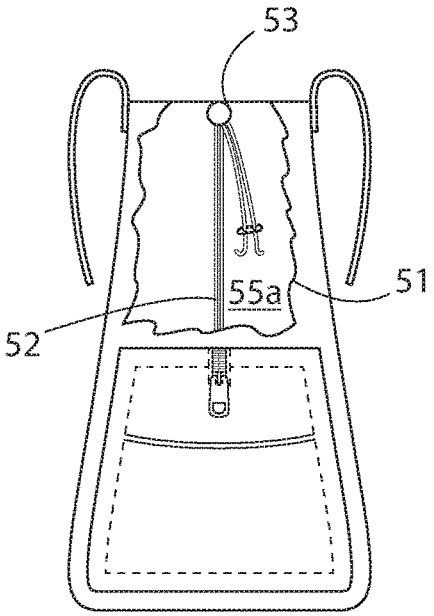
FIGS. 8*c*, 8*d* and 8*e* show three stages for an inner lining with a draw string which permits it to hang at various lengths within the handbag.
Figure 8D:
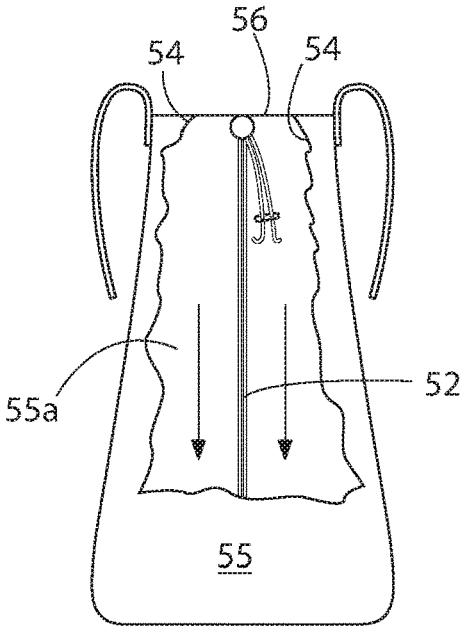
Figure 8E:
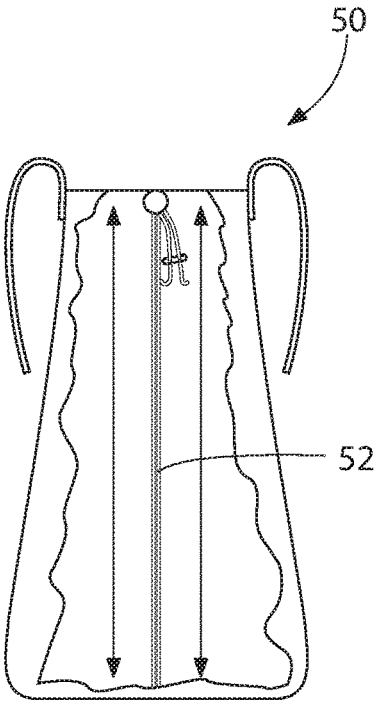

An alternative to the adjustable dividing system is an adjustable lining system 50, FIGS. 8*c*, 8*d* and 8*e*. An adjustable lining 51 extends downwardly into the main compartment 11 from the top 11*a* of the bag 10 to create upper and lower compartments. The lining is bag-shaped or pouch-shaped with walls and a closed bottom. The inside of the lining forms the upper compartment 55*a* which the space below the lining bottom forms the lower compartment 55. The lining includes a drawstring 52 which permits it to be adjusted in length from a distance near the top 11*a* of the bag 10 to extend to the very bottom, FIG. 8*e*. The drawstring includes a lock 53 for locking the length (extension) of the lining 51.

When used, the lining covers the inside walls of the main compartment 11. The drawstrings 52 are stitched into the lining 51 at a gusset 56 sewn into the inside wall of the bag 10. The locks 53 to hold the drawstrings 52 and thus the lining 51 in place when pulled to contract or released to expand. To contract the lining system the user would unlock the locking system 53, pull the drawstrings in an upward position, adjusting the lining to the desired height, then position and release the locks to hold the lining in place.

The user may use fasteners 23 to snap the lining 51 to the wall of the foundation bag creating an additional pocket in the upward compartment of the foundation handbag. In its contracted position, the lining system can create additional pockets using fasteners such as snap, hook-and-loop, zipper or any other known fasteners. To expand the lining 51 the user would unsnap the fasteners 23 and release the locks 53, push down on the lining system to extend the lining to the length of the bag creating one compartment. In this configuration, the user may carry the handbag as a single tote.

When the divider floor 21 is held in position by a zipper 22, FIG. 9*a*, the zipper 22 system may be implemented with a pair of zipper sliders 22*a*, 22*b*, FIG. 9*a*, one for the zipper teeth on each side of the divider floor. The sliders 22*a*, 22*b*, are connected to a pull handle 22*c* so that they act in unison from the gusset 56 attachment wall of the bag 10 to the mid point of the opposite wall. In the arrangement, there are two half-length zippers 22 securing the divider floor 21.

c. Adjustable Lower Dividing System

Figure 6B:
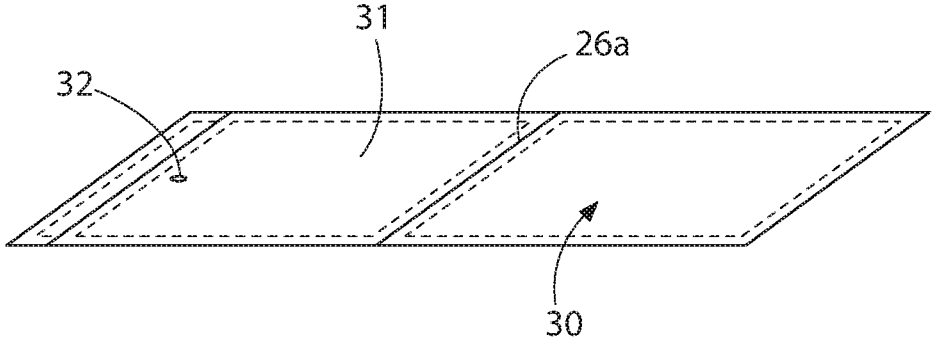
FIG. 6*b* is a perspective view of the divider floor separated from the bag.

When the secondary inner bag 40 is not used, an adjustable lower divider (or flap) insert 30 FIG. 6*b*, can be affixed to the bottom floor 35 of the bag 10, FIG. 6*a*, to be used to create additional compartments in the lower compartment 25 as recited above. When the flap 31 on the lower dividing system insert 31 stands vertically, creates separate compartments. When it is laid down, it opens the lower compartment 25 to a single compartment.

The insert 30 can be attached permanently or temporarily to the bottom 35 of the bag 10 by stitching, magnetic snaps, hook-and-loop, or other fastening mechanism. The flap 31 can have snap fastener 32 at its proximal end and a mating snap fastener 32*a* at its distal end, with a fold line 26*a* at mid-length of the insert 30.

Figure 12A:
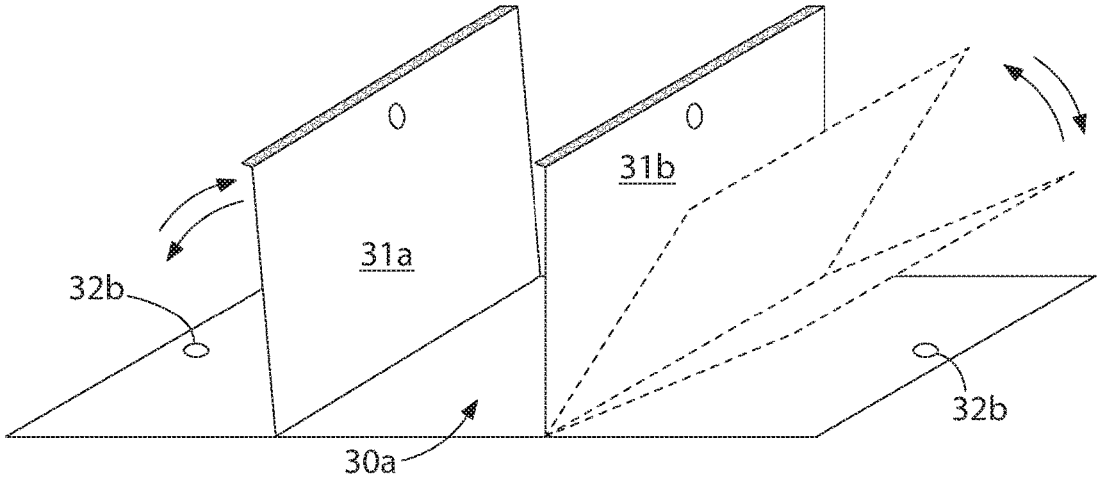
FIG. 12*a* shows a perspective of the bottom floor of the handbag with two separator flaps secured to the face thereof.
Figure 12B:
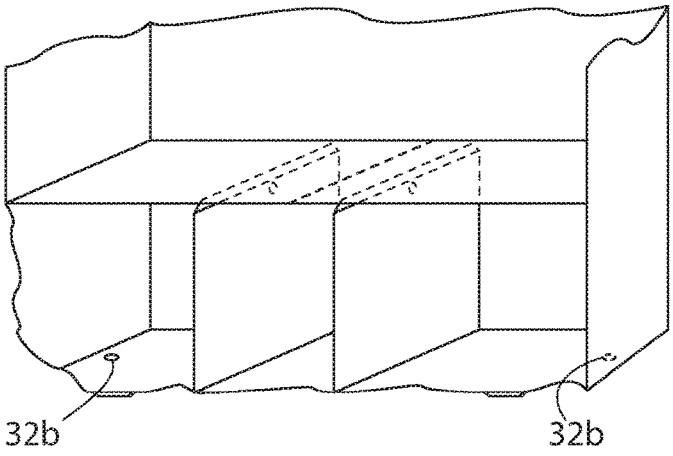
FIG. 12*b* shows perspective cut-away view of the handbag with the two separator flaps held to the divider floor to make three compartment sections in the lower compartment.

Adding additional flaps, FIGS. 12*a* and 12*b*, to the lower dividing system can create additional compartments within the lower compartment of the handbag system.

When the flap 31 is pivoted upward, to stand upright, it can be attached to the bottom face of the divider floor 21 with a hook and loop or other type of fastener structure. Alternatively, the flap 31 can be attached the back wall of the main compartment 11 with any of several types of releasable fasteners. The adjustable lower dividing system is only used when the insulated secondary inner bag is removed from the foundation bag. Alternatively, several flaps 31*a*, 31*b* may be attached to the insert 30*a*, FIG. 12*a*. This insert 30*a* can be permanently stitched to the bottom 35 of the handbag with a plurality of snap fasteners 32*b*. The multiple flaps 31*a*, 31*b* can be secured in an upright position of affixed in a folded down position, similar to the single flap 31 system described above. The several flaps create several smaller sub-compartments when such compartments are desired.

d. Insulated Secondary Inner Bag

Figure 7A:
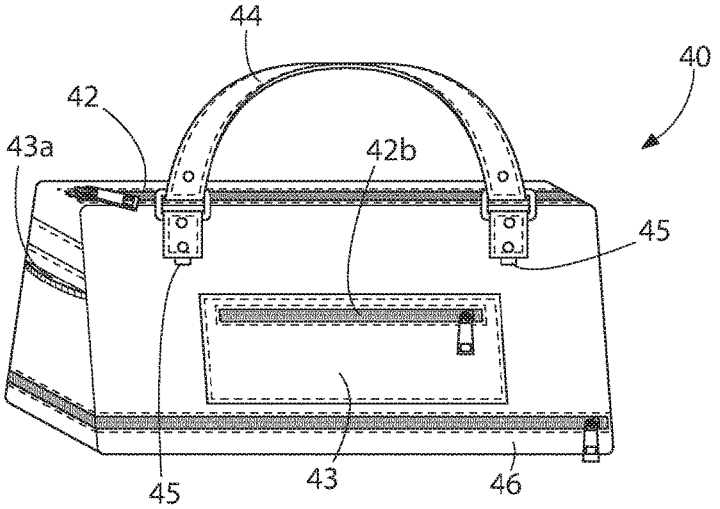
FIG. 7*a* is a front perspective view of insulated secondary bag with its expanded bottom.
Figure 7B:
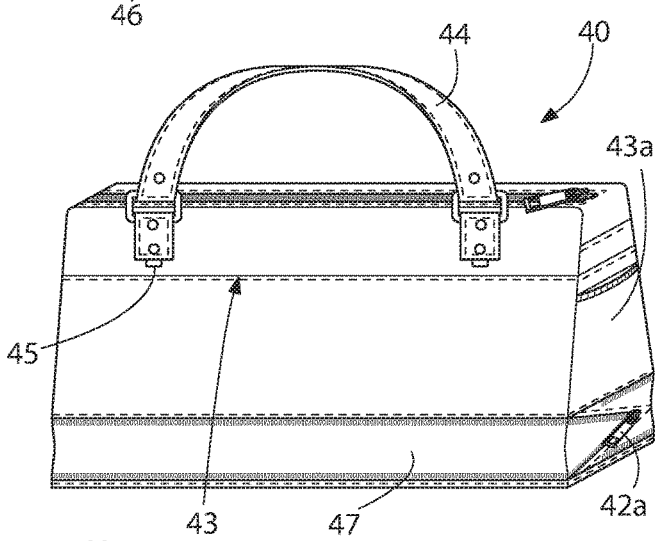
FIG. 7*b* is a rear perspective view of the insulated secondary bag with the zipper loosened permitting the bag to expand at its bottom.
Figure 7C:
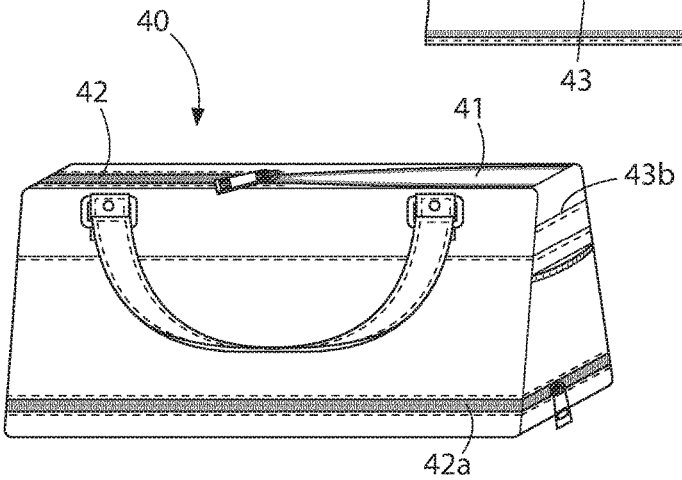
FIG. 7*c* is a rear perspective with the top zipper partially open.

The insulated secondary inner bag, FIGS. 7*a*, 7*b* and 7*c*, is used as another means for storing and carrying items separate from items kept in the upper compartment of the handbag. The secondary inner handbag is accessed through the front flap of the bag (or alternative side). The secondary inner handbag is removable and can be carried separately from the handbag 10.

The secondary bag 40 is expandable in height, FIG. 7*b*, upon the release of a side zipper 42*a*, adjacent a bottom sidewall flap 47, which is opened to expand the secondary bag 40. The secondary bag 40 includes a pair of handles 44 for carrying the bag 40, and has a series of side and end exterior pockets, 43, 43*a*, and 43*b*, as well as interior pockets on the inside of the bag 40 (not shown). The rear exterior pocket 43 is accessible through a rear zipper 42*b*.

The secondary bag 40 may be insulated to keep food items cool or warm. Nonfood items may also be stored in the secondary bag such as baby items, clothing, shoes, cosmetics, toys, etc.

The insulated secondary inner handbag 40 is a smaller handbag intended to be stored in the lower compartment 25 of the handbag 10. Once removed from the handbag 10, the secondary handbag 40 may be extended in height by unzipping a lower zipper 42*a*. The secondary handbag 40, when closed (unexpanded) 46, FIG. 7*a*, will fit into the lower compartment 25 of the handbag 10. The open expanded bag 47 may be used when carrying the insulated secondary inner bag 40, separately. The insulated secondary inner bag 40 allows the user to organize and separate items stored in the upper compartment from items stored in the lower compartment of the foundation handbag. The secondary handbag 40 includes rings 45, FIGS. 7*a* and 7*b*, to be attached to the clips 19 on the pouch 13*a* wall to assist in removing the secondary handbag 40 from the main compartment 11, when the front flap 13 is open and the pouch 13*a* is pulled forward.

Access of the interior 41 of the secondary bag 40 is through a zipper 42 extending along the top of the main compartment 41. The insulated secondary handbag 40 is made with materials to help keep food items cool or warm.

An alternative to the secondary inner bag 40 is to insulate the lower compartment 25 of the main compartment 11 of the handbag 10. This may be done in the presence or absence of compartments, thereby allowing the user to store food items in the handbag without the need for the secondary inner bag 40. The secondary handbag 40 may also be collapsible and/or foldable with or without insulation. The secondary inner bag 40 may also be exchanged with several smaller bags that can be stored in the handbag 10 main compartment 11 when smaller compartments of features.

e. Alternative Lining System

An alternative adjustable lining system acts as a separator creating multiple compartments within the handbag system. The lining system is adjustable by pulling the interlocking drawstrings to contract the lining system creating upper and lower compartments.

The lining system can also create additional pockets within the upper compartment when it is secured in a contracted (withdrawn) position using hook-and-loop, snaps, magnets or other fasteners. The interlocking drawstrings can be released to expand the lining system to the length of the foundation handbag when the secondary inner handbag is not in use thereby using the foundation bag as a tote with one compartment.

The adjustable lining system is made of fabric material referred to as the lining 51 and includes drawstrings 52, locks 53 and fasteners 54. The lining 51 is permanently secured to the top 11*a* of the bag by stitching. Snap type fasteners 54 secure the lining 51 at the top 11*a* of the bag. The lining covers the inside walls of the main compartment 11. The drawstrings 52 are stitched into the lining 51 at a gusset 56 on the wall of the handbag 10. Attached to the drawstrings are locks 53 to hold the lining system in place when pulled to contract or release when expanded. To contract (withdraw) the lining system a user would unlock the locks 53, pull the drawstrings 52 in an upward direction thereby adjusting the lining 51 to the desired height, then position and release the locking system to hold the lining in place. The user may use additional fasteners 54 to snap the lining 51 to the wall of the main compartment 11 of the bag 10, thereby creating an additional pocket in the upward compartment of the foundation handbag. In its contracted position, the lining system can further create additional pockets using additional fasteners.

To expand the lining system 50 the user would unsnap the pocket fasteners and release the locks 53, push down on the lining system to extend the lining to the length of the main compartment 11 of the foundation handbag 10 thereby creating one compartment.

f. Alternate Access

An alternative access 60 to the secondary inner bag may include an opening on the side of the foundation handbag 10. An alternate access 60 to the secondary inner handbag 40 would be through a side flap structure 61, 61*a*, FIG. 8*b*.

g. Connections of Main Elements and Sub-Elements

The zipper 12, front flap 13, handles 14, outside pockets 15, footed bottoms 17, fasteners 18 are connected to the foundation handbag 10, FIGS. 1*a* and 1*b*. The fastener 19 is connected to the front flap 13 which is connected to the foundation handbag 10, FIG. 2. The footed bottoms 17 are connected to the bottom of the foundation handbag, FIGS. 1*a* and 1*b*. A pocket is positioned in the back of the foundation handbag, FIG. 1*a*. Clips 19 are attached to the inner wall of the inside flap 13, FIG. 5*b*. The adjustable dividing system 20 is connected to the wall or gusset of the main compartment 11 of the foundation handbag, FIGS. 4*a*, 4*b*, and 4*c*. The dividing system creates an upper compartment 24 and lower compartment 25, FIGS. 4*a*, 9*a*, and 10*a*. The lower dividing system 30 creates a right and left compartment within the lower compartment of the foundation handbag when the flap is upright and is connected to the bottom.

The insulated secondary inner bag 40 is connected to the inside front flap 13 by clips 19, FIG. 5*b*. When the front flap 13 is opened the secondary bag 40 attached to the pouch 13*a* by the clips 19 pulls the secondary bag 40 forward, FIGS. 5*a*, 5*b*. The secondary inner bag 40 is then removable from foundation handbag 10, to be carried separately, FIGS. 7*a*, 7*b*, 7*c*. The handles 44, pockets 43, zipper 42, and rings 45 are connected to the secondary inner bag 40. The secondary inner bag 40 has a main compartment 41 which is accessible by zipper 42, and a back pocket 43.

h. Alternative Embodiments

The alternate lining system 50 is connected to the main compartment 11 of the foundation handbag 10, FIGS. 8*c*, 8*d*, and 8*e*, wherein the lining is connected to the inside walls to create two compartments. The lining system may be expanded or contracted, or may be removed altogether. In the contracted position, the lining 51 creates an upper and lower compartment, and in the expanded position, the user may carry the foundation handbag as a tote with one compartment. The alternate access 60 to the secondary bag is through a side flap 61.

Figure 10A:
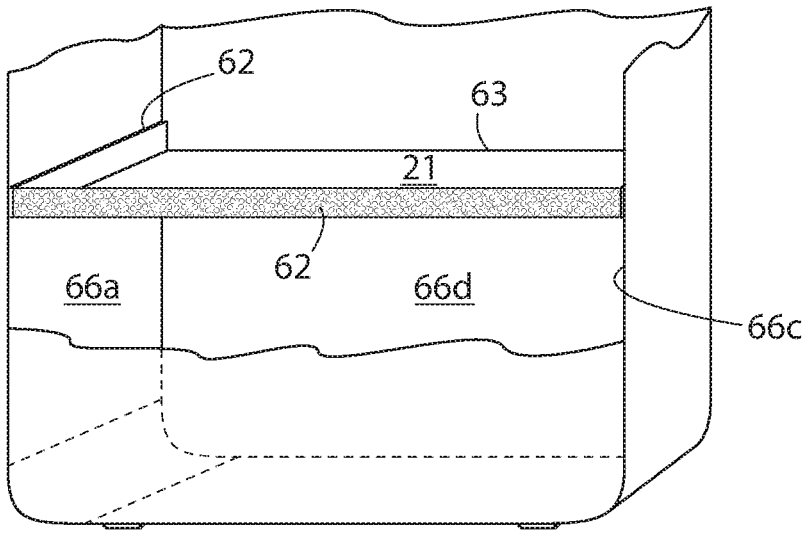
FIG. 10*a* is a perspective cut-away view of an alternative mounting for the divider floor along the back wall of the handbag with Velcro® releases on the other three sides.
Figure 10B:
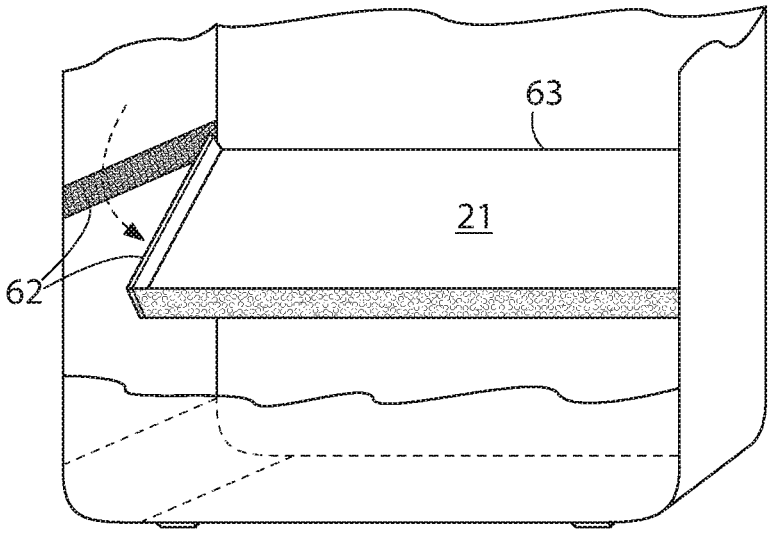
FIG. 10*b* is a view of FIG. 10*a* with the Velcro® released and the divider floor folded down.
Figure 11A:
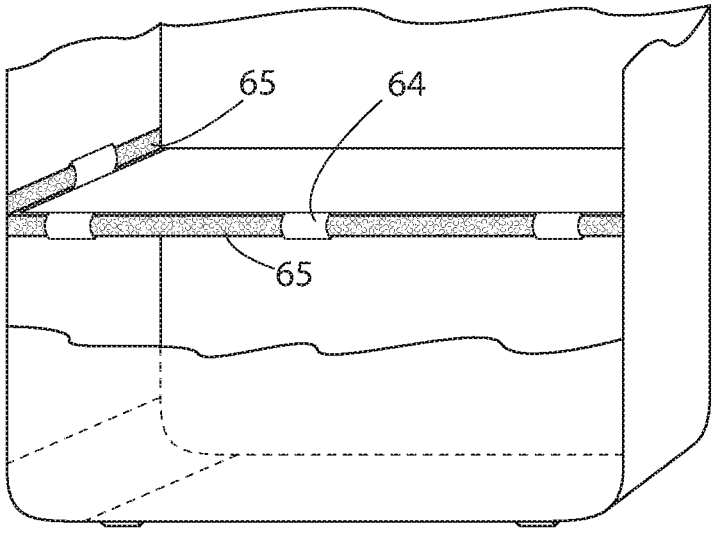
FIG. 11*a* is a view of FIG. 10*b* with the Velcro® sleeve substituted for the Velcro® hook and fabric of FIG. 10*a;*
Figure 11B:
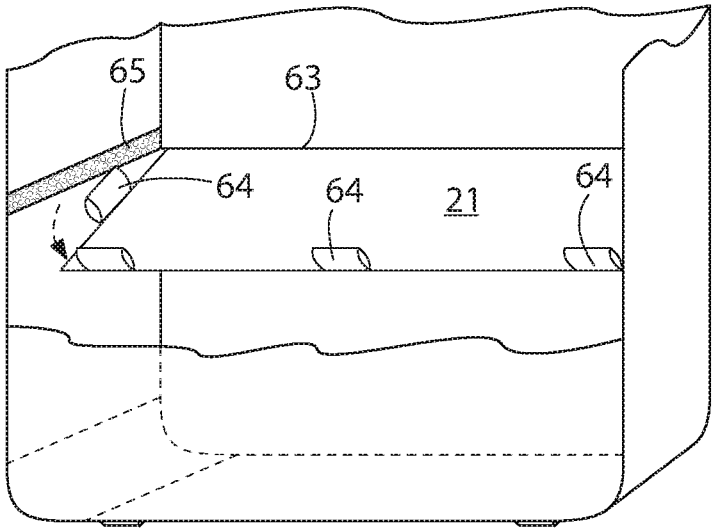
FIG. 11*b* is an alternative to FIG. 10*b* with the divider floor released and partially folded down.

The divider floor 21, can be attached to the inside walls of the foundation handbag main compartment with a hook and loop, or Velcro® type releasable securement on three sides of the floor, FIGS. 10*a* and 10*b*. Where the divider floor is permanently attached 63 to the back wall, the floor merely folds down against the back wall to open up the main compartment 11. As a further alternative a series of Velcro® type sleeves 64 can be spaced about the three sides of the divider floor to engage fabric bars 65 positioned on the three interior walls 66*a*, 66*b*, 66*c* of the main compartment 11.

i. Operation

The 2-in-1 handbag with an adjustable compartment system is a women's multipurpose handbag system that can be used as a combination handbag eliminating the need to carry additional bags at the same time. The foundation handbag features a removable insulated secondary inner handbag, adjustable upper compartment system, and adjustable lower compartment system. An adjustable upper dividing compartment creates two distinctly defined storage areas, an upper and a lower compartment within the foundation handbag. In the adjustable lower compartment, there can be created plural separately defined areas. The user can access the upper system through the zipper attached at the top of the handbag. The user can access the lower system through the front flap or a side flap. The inner bag is accessed and pulled outward with the assistance of clips attaching the inner bag to the front face of the pouch.

Whereas women will purchase and carry multiple bags simultaneously to store items such as a wallet, keys, lunch, shoes, baby items, gym attire and travel toiletries, the 2-in-1 handbag with its adjustable compartment systems provides the ability to store items used for these purposes in one foundation bag. The 2-in-1 handbag system of the present invention is designed to provide functionality for the purpose of separating and organizing many different items in one bag. The secondary inner handbag can be insulated to keep food items cool or warm, and can be used to store commonly carried items that the user would like to separate from other items. There are pockets and compartments for such items as food, a wallet, a cell phone, keys, glasses, shoes, and other personal items, such as clothing and toiletry items, baby bottles, and toys.

Elements List

10: Foundation Handbag
11: Main Compartment
11*a* Top of bag
12: Top Zipper
12*a*: Shallow Pocket Zipper
13: Front Flap
13*a*: Pouch
14: Handles
14*a*: Shoulder Strap
14*b*: Mounting Loops for Strap
14*c*: Metal Links
15*a*: Outside Back Pocket
15*b*: Outside End Pocket
15*c*: Outside End Pocket
16*a*: Inside Pocket
16*b*: Inside Pocket
16*c*: Inside Pocket
16*d*: Inside Pocket
17: Footed Bottoms
18: Strap Fastener
18*a*: Spring Release Button
19: Clamping Clips
20: Adjustable Upper Dividing System
21: Divider Floor
21*a*: Remaining End of Divider Floor
22: Divider Floor Zipper
22*a*: Slider for zipper
22*b*: Slider for zipper
22*c*: Pull
23: Snap Fastener
23*a*: Second Snap Fastener
23*b*: Snap or Magnetic Fastener
23*c*: Snap or Magnetic Fastener
23*d*: Snap or Magnetic Fastener
24: Upper Compartment
25: Lower Compartment
26: Fold
26*a*: Fold Line
30: Adjustable Lower Dividing System
30*a*: Lower Dividing System Insert
31: Flap Folding Panel
31*a*: Flap
31*b*: Flap
32: Fastener
32*a*: Mating Snap Fastener
32*b*: Snap fastener
33: Right Compartment
34: Left Compartment
35: Floor of Handbag
40: Insulated Secondary Inner Bag
41: Main Compartment
42: Inner Bag Top Zipper
42*a*: Side Zipper
42*b*: Rear Zipper
43: Exterior Pocket
43*a*: Exterior Pocket
43*b*: Exterior Pocket
44: Handles
45: Handle Rings
46: Closed Expanded Bag
47: Open Expanded Bag
50: Alternative Lining System
51: Lining
52: Drawstring
53: Locks
54: Fasteners
55: Lower Compartment
55*a*: Upper Compartment
56: Gusset
60: Alternate Access
61: Side Flap
61*a*: Upper Keeper Flap
62: Velcro® Type Securement
63: Permanent Attachment
64: Velcro® Type Sleeves
65: Fabric Bar
66*a*: Interior Side Wall
66*b*: Interior Front Wall
66*c*: Interior Side Wall
66*d*: Interior Back Wall Many changes can be made in the above-described invention without departing from the intent and scope thereof. It is therefore intended that the above description be read in the illustrative sense and not in the limiting sense. Substitutions and changes can be made while still being within the scope and intent of the invention and of the appended claims.

In this respect, it is to be understood that the invention is not limited in its application to the details of construction or to the arrangements of the components set forth in the detailed description or illustrated in the drawings. The invention is capable of other embodiments and of being practiced and carried out in various ways. Further, it is to be understood that the phraseology and terminology employed herein should not be regarded as limiting.

The invention claimed is:

1. A utility handbag, comprising:

a main compartment having a front wall, a back wall opposing said front wall, a first and second side walls opposing each other, and a bottom attached to all of said walls, and a top;

a closure structure for closing the top of said main compartment;

a pair of carrying handles attached, respectively one each to two opposing walls of said main compartment;

a divider structure for separating said main compartment into an upper compartment and a lower compartment, wherein said divider structure includes a retractable lining wherein said lining divides said main compartment into an upper compartment and a lower compartment; and an access flap for accessing the lower compartment area when said main compartment is divided, wherein said lining has sides, a bottom and an open top, said top being attached to each of the inside walls of said main compartment, and wherein said inside of said lining forms an upper compartment and the area in the main compartment below the lining forms a lower compartment, and wherein the lining also includes a drawstring and at least one lock, said drawstring setting the length of said lining and said lock holding that length wherein the relative size of said upper and lower compartments can be adjusted.

2. A utility handbag according to claim 1 further comprising fasteners to snap the lining to a wall of the handbag to create an additional pocket in the upper compartment of the handbag.

3. A utility handbag according to claim 2 wherein the fasteners are selected from snap, hook-and-eye and zipper fasteners.

* * * * *